US010192484B2

(12) United States Patent
Li et al.

(10) Patent No.: US 10,192,484 B2
(45) Date of Patent: Jan. 29, 2019

(54) PIXEL CIRCUIT AND DRIVING METHOD THEREOF, DISPLAY PANEL AND DISPLAY DEVICE

(71) Applicants: BOE TECHNOLOGY GROUP CO., LTD., Beijing (CN); BEIJING BOE DISPLAY TECHNOLOGY CO., LTD., Beijing (CN)

(72) Inventors: Feng Li, Beijing (CN); Baoqiang Wang, Beijing (CN)

(73) Assignees: BOE Technology Group Co., Ltd., Beijing (CN); Beijing BOE Display Technology Co., Ltd., Beijing (CN)

( * ) Notice: Subject to any disclaimer, the term of this patent is extended or adjusted under 35 U.S.C. 154(b) by 0 days.

(21) Appl. No.: 15/307,182

(22) PCT Filed: Mar. 3, 2016

(86) PCT No.: PCT/CN2016/075464
§ 371 (c)(1),
(2) Date: Oct. 27, 2016

(87) PCT Pub. No.: WO2017/045376
PCT Pub. Date: Mar. 23, 2017

(65) Prior Publication Data

US 2017/0270859 A1 Sep. 21, 2017

(30) Foreign Application Priority Data

Sep. 17, 2015 (CN) ..... 2015 1 0596094

(51) Int. Cl.
*G09G 3/30* (2006.01)
*G09G 3/3258* (2016.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC .. G09G 3/3233; G09G 3/3241; G09G 3/3266; G09G 3/3283; G09G 2320/0233;
(Continued)

(56) References Cited

U.S. PATENT DOCUMENTS

2007/0290973 A1 12/2007 Wei
2011/0084947 A1* 4/2011 Chung ..... G09G 3/3233 345/211

(Continued)

FOREIGN PATENT DOCUMENTS

CN 103093723 A 5/2013
CN 103531151 A 1/2014

(Continued)

OTHER PUBLICATIONS

Written Opinion of the International Searching Authority from corresponding PCT Application No. PCT/CN2016/075464, dated Jun. 14, 2016 (5 pages).

*Primary Examiner* — Jimmy H Nguyen
(74) *Attorney, Agent, or Firm* — Harness, Dickey & Pierce, P.L.C.

(57) ABSTRACT

The embodiments of the present disclosure provide a pixel circuit and a driving method thereof, a display panel and a display device, which relate to the field of display technology, and can prevent the drift of the threshold voltage of a driving transistor from affecting the driving current of an active light emitting device. The pixel circuit comprises: a preset unit, a compensation unit, a data writing unit, a
(Continued)

driving unit, an energy storage unit, and a light emitting unit. The embodiments of the present disclosure can be used to manufacture display devices.

20 Claims, 7 Drawing Sheets

(51) Int. Cl.
*G09G 3/3233* (2016.01)
*G09G 3/3266* (2016.01)
*G09G 3/3275* (2016.01)

(52) U.S. Cl.
CPC ... *G09G 3/3275* (2013.01); *G09G 2300/0426* (2013.01); *G09G 2300/0819* (2013.01); *G09G 2300/0842* (2013.01); *G09G 2300/0861* (2013.01); *G09G 2320/0233* (2013.01); *G09G 2320/043* (2013.01); *G09G 2320/045* (2013.01); *G09G 2320/0626* (2013.01)

(58) Field of Classification Search
CPC ..... G09G 2320/043; G09G 2320/04; G09G 2310/0251; G09G 2300/0842; G09G 2300/0866; G09G 2300/0861; G09G 2300/0814; G09G 2320/045; G09G 3/3258; G09G 3/3275; G09G 2320/0626; G09G 2300/0426
USPC ..... 345/76–83
See application file for complete search history.

(56) References Cited

U.S. PATENT DOCUMENTS

2015/0187270 A1* 7/2015 Lee ..... G09G 3/3233 345/76
2015/0356924 A1* 12/2015 Chen ..... G09G 3/3233 345/690

FOREIGN PATENT DOCUMENTS

CN 104050916 A 9/2014
CN 104751798 A 7/2015
CN 105096837 A 11/2015

* cited by examiner

PIXEL CIRCUIT AND DRIVING METHOD THEREOF, DISPLAY PANEL AND DISPLAY DEVICE

CROSS-REFERENCE TO RELATED APPLICATION

This application claims the benefit and priority of Chinese Patent Application No. 201510596094.8, filed on Sep. 17, 2015, the entire disclosure of which is incorporated by reference herein.

FIELD

The present disclosure relates to the field of display technology, and particularly to a pixel circuit and a driving method thereof, a display panel and a display device.

BACKGROUND

Active Matrix Organic Light Emitting Diode (abbreviated as AMOLED) panel has advantages like low power consumption, low production cost, wide viewing angle and fast response speed, whereby the AMOLED display has gradually replaced the traditional liquid crystal display. Organic light emitting diodes (OLEDs) are current-driven, with the working principle that the recombination of electrons and holes produces radiation light, that is, electrical energy is directly converted into light energy, whereby a stable current is required to control light emission in display.

Currently an OLED is driven by a Drive Thin Film Transistor (abbreviated as DTFT), and the DTFT is usually a P-type switch transistor. The DTFT has a gate electrode connected to a data input terminal $V_{data}$, a source electrode connected to a constant voltage power supply input terminal $V_{DD}$, and a drain electrode connected to the OLED. A voltage difference $V_{GS}$ is generated between $V_{DD}$ of the source electrode and $V_{data}$ of the gate electrode so that the DTFT is turned on to drive the OLED, and the driving current of the OLED $I_{OLED}=K(V_{GS}-V_{th})^2$, wherein $V_{th}$ is the threshold voltage of the DTFT itself and K is constant.

As can be seen from the driving current formula above-mentioned, the threshold voltage $V_{th}$ of the DTFT will affect the driving current flowing through the OLED, while errors caused by manufacturing processes, device aging and other reasons will cause the threshold voltage $V_{th}$ of the DTFT in each pixel unit to drift, cause deviation in the driving current flowing through the OLED, and further affect the display effect.

SUMMARY

Embodiments of the present disclosure provide a pixel circuit and a driving method thereof, a display panel and a display device, capable of preventing a drift of the threshold voltage of the driving transistor from affecting the driving current of an active light emitting component, thereby improving the uniformity of a displayed image.

According to a first aspect of the present disclosure, there is provided a pixel circuit comprising: a preset unit, a compensation unit, a data writing unit, a driving unit, an energy storage unit, and a light emitting unit. The preset unit is connected to a first scanning signal terminal, a first node, a second node, a third node and a second electric level terminal. The preset unit is configured to connect the first node and the third node to the second electric level terminal, and to connect the first scanning signal terminal to the second node, under the control of a signal of the first scanning signal terminal. The compensation unit is connected to a second scanning signal terminal, the first node, the second node, the third node, a fourth node and the second electric level terminal. The compensation unit is configured to connect the first node and the third node to the second electric level terminal, and to connect the fourth node to the second node, under the control of a signal of the second scanning signal terminal. The data writing unit is connected to a third scanning signal terminal, a data signal terminal and the first node, and is configured to connect the data signal terminal to the first node under the control of a signal of the third scanning signal terminal. The energy storage unit is connected to the first node and the second node, and is configured to store a voltage between the first node and the second node. The driving unit is connected to the second node, the third node and the fourth node, and is configured to output a driving signal to the third node under the control of the voltage between the second node and the fourth node. The light emitting unit comprises a light emission control unit and a light emitting component. The light emission control unit is connected to a control signal terminal, the third node, the fourth node, the first electric level terminal and the light emitting component; and the light emitting component is connected to the light emission control unit and the second electric level terminal. The light emission control unit is configured to connect the first electric level terminal to the fourth node and to connect the third node to the light emitting component under the control of the control signal terminal; the light emitting component is configured to emit light under the control of the driving signal and a signal of the second electric level terminal.

In the embodiments of the present disclosure, the preset unit comprises a third transistor, a fourth transistor, and a fifth transistor. A control electrode of the third transistor is connected to the first scanning signal terminal, a first terminal of the third transistor is connected to the first scanning signal terminal, and a second terminal of the third transistor is connected to the second node. A control electrode of the fourth transistor is connected to the first scanning signal terminal, a first terminal of the fourth transistor is connected to the first node, and a second terminal of the fourth transistor is connected to the second electric level terminal. A control electrode of the fifth transistor is connected to the first scanning signal terminal, a first terminal of the fifth transistor is connected to the third node, and a second terminal of the fifth transistor is connected to the second electric level terminal.

In the embodiments of the present disclosure, the compensation unit comprises a sixth transistor, a seventh transistor, and an eighth transistor. A control electrode of the sixth transistor is connected to the second scanning signal terminal, a first terminal of the sixth transistor is connected to the first node, and a second terminal of the sixth transistor is connected to the second electric level terminal. A control electrode of the seventh transistor is connected to the second scanning signal terminal, a first terminal of the seventh transistor is connected to the fourth node, and a second terminal of the seventh transistor is connected to the second node. A control electrode of the eighth transistor is connected to the second scanning signal terminal, a first terminal of the eighth transistor is connected to the third node, and a second terminal of the eighth transistor is connected to the second electric level terminal.

In the embodiments of the present disclosure, the data writing unit comprises a first transistor. A control electrode of the first transistor is connected to a third scanning signal terminal, a first terminal of the first transistor is connected to the data signal terminal, and a second terminal of the first transistor is connected to the first node.

In the embodiments of the present disclosure, the driving unit comprises a second transistor. A control electrode of the second transistor is connected to the second node, a first terminal of the second transistor is connected to the fourth node, and a second terminal of the second transistor is connected to the third node.

In the embodiments of the disclosure, the energy storage unit comprises a first capacitor. A first electrode of the first capacitor is connected to the first node and a second electrode of the first capacitor is connected to the second node.

In the embodiments of the present disclosure, the light emission control unit comprises a ninth transistor and a tenth transistor, and the light emitting component comprises an organic light emitting diode. A control electrode of the ninth transistor is connected to the control signal terminal, a first terminal of the ninth transistor is connected to the first electric level terminal, and a second terminal of the ninth transistor is connected to the fourth node. A control electrode of the tenth transistor is connected to the control signal terminal, a first terminal of the tenth transistor is connected to the third node, and a second terminal of the tenth transistor is connected to a first electrode of the organic light emitting diode. A second electrode of the organic light emitting diode is connected to the second electric level terminal.

According to a second aspect of the present disclosure, there is provided a display panel comprising any of the above-described pixel circuits.

According to a third aspect of the present disclosure, there is provided a display device comprising the above-described display panel.

According to a fourth aspect of the present disclosure, there is provided a driving method of a pixel circuit for driving any one of the above-described pixel circuits, comprising: a first stage, in which a preset unit connects a first node and a third node to a second electric level terminal, and connects a first scanning signal terminal to a second node under the control of a signal of the first scanning signal terminal. A second stage, in which a compensation unit connects the first node and the third node to the second electric level terminal and connects a fourth node to the second node under the control of a signal of the second scanning signal terminal. An energy storage unit stores the threshold voltage of a driving unit. A third stage, in which a data writing unit connects a data signal terminal to the first node under the control of a signal of a third scanning signal terminal. A fourth stage, in which the driving unit outputs a driving signal to the third node under the control of the voltage between the second node and the fourth node. The light emission control unit connects the first electric level terminal to the fourth node and connects the third node to the first electrode of the light emitting component under the control of the signal of the control signal terminal, the light emitting component emits light under the control of the driving signal and the signal of the second electric level terminal.

In the embodiments of the present disclosure, the preset unit comprises a third transistor, a fourth transistor, and a fifth transistor. In the first stage, the third transistor, the fourth transistor and the fifth transistor are in the ON state under the control of the signal of the first scanning signal terminal, the first node is connected to the second electric level terminal via the fourth transistor, the third node is connected to the second electric level terminal via the fifth transistor, and the first scanning signal terminal is connected to the second node via the third transistor.

In the embodiments of the present disclosure, the compensation unit comprises a sixth transistor, a seventh transistor, and an eighth transistor. In the second stage, the sixth transistor, the seventh transistor and the eighth transistor are in the ON state under the control of the signal of the second scanning signal terminal, the first node is connected to the second electric level terminal via the sixth transistor, the third node is connected to the second electric level terminal via the eighth transistor, and the second node is connected to the fourth node via the seventh transistor.

In the embodiments of the present disclosure, the data writing unit comprises a first transistor. In the third stage, the first transistor is in the ON state under the control of the signal of the third scanning signal terminal, the data signal terminal is connected to the first node via the first transistor.

In the embodiments of the present disclosure, the light emitting unit comprises a ninth transistor, a tenth transistor, and an organic light emitting diode. In the fourth stage, the ninth transistor and the tenth transistor are in the ON state under the control of the signal of the control signal terminal, the first electric level terminal is connected to the fourth node via the ninth transistor and the third node is connected to the first electrode of the organic light emitting diode via the tenth transistor, and the organic light emitting diode is controlled to emit light with the driving signal and the signal of the second electric level terminal connected to the second electrode of the organic light emitting diode.

The embodiments of the present disclosure provide a pixel circuit and a driving method thereof, a display panel, and a display device, capable of compensating a threshold voltage of a driving unit by a compensation unit to prevent the drift of a threshold voltage of a driving transistor of the driving unit from influencing the driving current of an active light emitting component, thereby improving the uniformity of displayed image.

BRIEF DESCRIPTION OF THE DRAWINGS

In order to more clearly illustrate embodiments of the present disclosure, the drawings to be used in the embodiments will be briefly described below. Obviously the drawings described below in the description are merely for some embodiments of the present disclosure, and those skilled in the art may also obtain other drawings according to these drawings without creative work.

DETAILED DESCRIPTION

Figure 1:
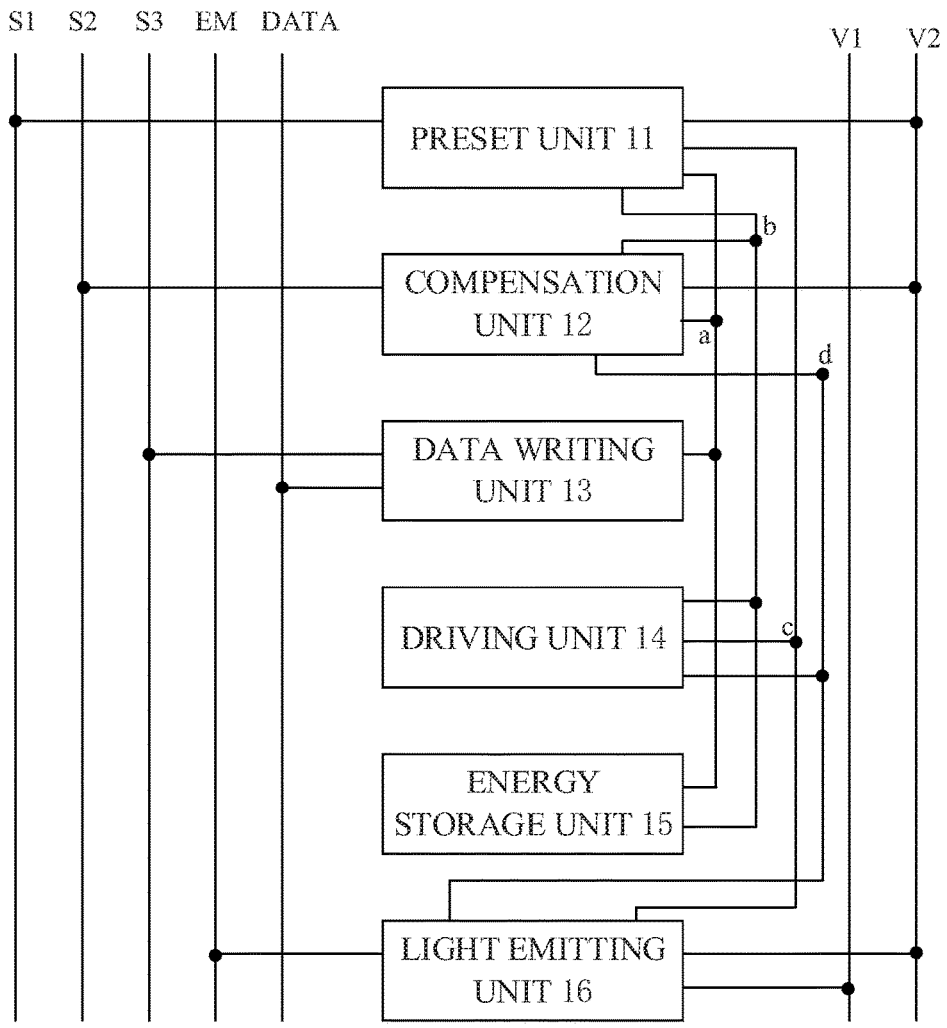
FIG. 1 is a schematic structural diagram of a pixel circuit provided according to embodiments of the present disclosure.

The technical solutions in the embodiments of the present disclosure will be clearly and completely described below in combination with the drawings in the embodiments of the present disclosure. Obviously, the embodiments described are merely part of, instead of all the embodiments of the present disclosure. Based on the embodiments in the present disclosure, all other embodiments obtained by those skilled in the art without creative work belong to the scope of the present disclosure sought for protection.

The transistors employed in all embodiments of the present disclosure may be thin film transistors or field effect transistors or other components having the same properties, and the transistors employed in the embodiments of the present disclosure include driving transistors and switching transistors besides the driving transistors, according to the functions in the circuits. Since the source electrode and drain electrode of the switching transistor used here are symmetrical, the source electrode and drain electrode thereof are interchangeable. In the embodiments of the present disclosure, the control electrode is the gate electrode, and in order to distinguish the two electrodes of the transistor besides the gate electrode, the source electrode therein is referred to as the first terminal and the drain electrode is referred to as the second terminal. It is specified according to the shape in the drawings that the intermediate terminal of the transistor is defined as a gate electrode, the signal input terminal as the source electrode, and the signal output terminal as the drain electrode. Further, the switching transistor used in the embodiments of the present disclosure includes a P-type switching transistor and a N-type switching transistor, wherein the P-type switching transistor is turned on when the gate electrode is at a low level and turned off when the gate electrode is at a high level, and the N-type switching transistor is turned on when the gate electrode is at a high level and turned off when the gate electrode is at a low level; the driving transistor includes a P-type and a N-type, wherein the P-type driving transistor is in an amplified state or in a saturated state when the gate electrode voltage is at a low level (the gate electrode voltage is smaller than the source electrode voltage) and the absolute value of the voltage difference between the gate electrode and the source electrode is greater than the threshold voltage; wherein the N-type driving transistor is in an amplified state or saturated state when the gate electrode voltage is at a high level (the gate electrode voltage is greater than the source electrode voltage), and the absolute value of the voltage difference between the gate electrode and the source electrode is greater than the threshold voltage.

FIG. 1 is a schematic structural diagram of a pixel circuit provided according to embodiments of the present disclosure. Referring to FIG. 1, embodiments of the present disclosure provide a pixel circuit comprising a preset unit 11, a compensation unit 12, a data writing unit 13, a driving unit 14, an energy storage unit 15, and a light emitting unit 16. The preset unit 11 is connected to the first scanning signal terminal S1, the first node a, the second node b, the third node c, and the second electric level terminal V2. The preset unit 11 is configured to connect the first node a and the third node c to the second electric level terminal V2 and to connect the first scanning signal terminal S1 to the second node b under the control of the signal of the first scanning signal terminal S1. The compensation unit 12 is connected to the second scanning signal terminal S2, the first node a, the second node b, the third node c, the fourth node d, and the second electric level terminal V2. The compensation unit 12 is configured to connect the first node a and the third node c to the second electric level terminal V2 and to connect the fourth node d to the second node b under the control of the signal of the second scanning signal terminal S2.

The data writing unit 13 is connected to the third scanning signal terminal S3, the data signal terminal Data and the first node a, and is configured to connect the data signal terminal Data to the first node a, under the control of the signal of the third scanning signal terminal S3.

The energy storage unit 15 is connected to the first node a and the second node b, and is configured to store a voltage between the first node a and the second node b.

The driving unit 14 is connected to the second node b, the third node c and the fourth node d and is configured to output a driving signal to the third node c, under the control of the voltage between the second node b and the fourth node d.

The light emitting unit 16 comprises a light emission control unit and a light emitting component. The light emission control unit is connected to the control signal terminal EM, the third node c, the fourth node d, the first electric level terminal V1, and the light emitting component; and the light emitting component is connected to the light emission control unit and the second electric level terminal V2. The light emission control unit is configured to connect the first electric level terminal V1 to the fourth node d and to connect the third node c to the light emitting component under the control of the signal of the control signal terminal EM. The light emitting component is configured to emit light under the control of the driving signal and a signal of the second electric level terminal V2.

Hereinafter, the functions of the respective units during the process of compensating the threshold voltage of the driving unit 14 will be briefly described. Firstly, the preset unit pulls the electric levels of the first node and the third node to the electric level of the second electric level terminal, and writes the signal of the first scanning signal terminal into the second node under the control of the signal of the first scanning signal terminal. Secondly, the compensation unit pulls the electric levels of the first node and the third node to the electric level of the second electric level terminal under the control of the signal of the second scanning signal terminal; the compensation unit discharges the second node via the fourth node under the control of the signal of the second scanning signal terminal; the energy storage unit stores the threshold voltage of the driving unit. Thirdly, the data writing unit writes the signal of the data signal terminal into the first node under the control of the third scanning signal terminal. Finally, the driving unit outputs a driving signal to the third node under the control of the second node and the fourth node, the light emitting writes the signal of the first electric level terminal into the fourth node under the control of the control signal terminal, receives the driving signal of the third node under the control of the control signal terminal, and emits light under the control of the driving signal and the signal of the second electric level terminal. Wherein, since the energy storage unit stores the threshold voltage of the driving unit, in the light emitting stage, a threshold voltage compensation may be carried out to the driving unit directly with the stored threshold voltage.

The pixel circuit provided in the embodiments of the present disclosure is capable of performing threshold voltage compensation to the driving unit by the compensation unit to prevent the drift of the threshold voltage of the driving transistor of the driving unit from affecting the driving current of the active light emitting component thereby improving the uniformity of the display image.

Figure 2:
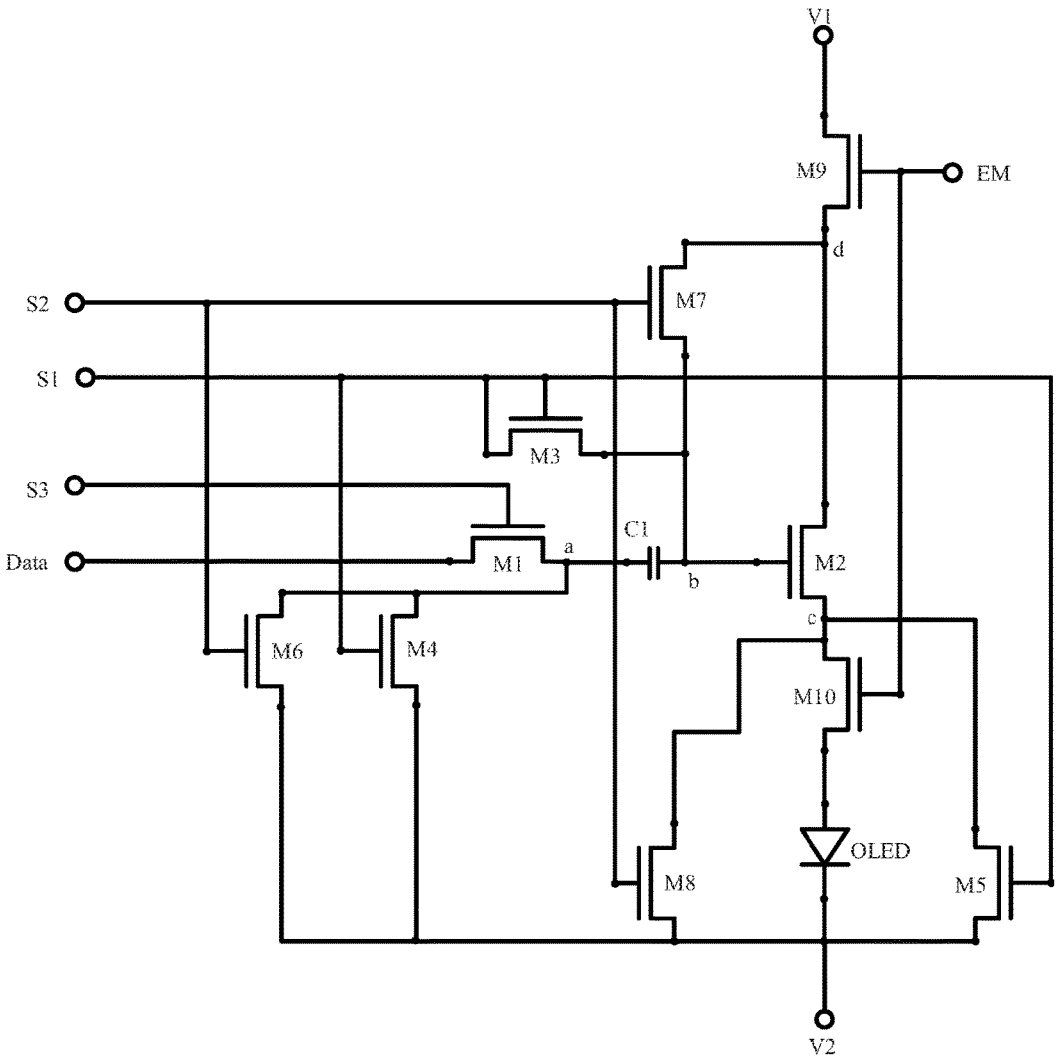
FIG. 2 is a schematic circuit diagram of the pixel circuit shown in FIG. 1.

FIG. 2 is a schematic circuit diagram of the pixel circuit shown in FIG. 1. Referring to FIG. 2, the preset unit 11 comprises a third transistor M3, a fourth transistor M4, and a fifth transistor M5. A gate electrode of the third transistor M3 is connected to the first scanning signal terminal S1, a first terminal of the third transistor M3 is connected to the first scanning signal terminal S1, and a second terminal of the third transistor M3 is connected to the second node b. A gate electrode of the fourth transistor M4 is connected to the first scanning signal terminal S1, a first terminal of the fourth transistor M4 is connected to the first node a, and a second terminal of the fourth transistor M4 is connected to the second electric level terminal V2. A gate electrode of the fifth transistor M5 is connected to the first scanning signal terminal S1, a first terminal of the fifth transistor M5 is connected to the third node c, and a second terminal of the fifth transistor M5 is connected to the second electric level terminal V2.

The compensation unit 12 comprises a sixth transistor M6, a seventh transistor M7, and an eighth transistor M8. A gate electrode of the sixth transistor M6 is connected to the second scanning signal terminal S2, a first terminal of the sixth transistor M6 is connected to the first node a, and a second terminal of the sixth transistor M6 is connected to the second electric level terminal V2. A gate electrode of the seventh transistor M7 is connected to the second scanning signal terminal S2, a first terminal of the seventh transistor M7 is connected to the fourth node d, and a second terminal of the seventh transistor M7 is connected to the second node b. A gate electrode of the eighth transistor M8 is connected to the second scanning signal terminal S2, a first terminal of the eighth transistor M8 is connected to the third node c, and a second terminal of the eighth transistor M8 is connected to the second electric level terminal V2.

The data writing unit 13 comprises a first transistor M1. A gate electrode of the first transistor M1 is connected to a third scanning signal terminal S3, a first terminal of the first transistor M1 is connected to the data signal terminal Data, and a second terminal of the first transistor M1 is connected to the first node a.

The driving unit 14 comprises a second transistor M2. A gate electrode of the second transistor M2 is connected to the second node b, a first terminal of the second transistor M2 is connected to the fourth node d, and a second terminal of the second transistor M2 is connected to the third node c.

The energy storage unit 15 comprises a first capacitor C1. A first electrode of the first capacitor C1 is connected to the first node a, and a second electrode of the first capacitor C1 is connected to the second node b.

The light emission control unit 16 comprises a ninth transistor M9 and a tenth transistor M10, and the light emitting component comprises an organic light emitting diode OLED. A gate electrode of the ninth transistor M9 is connected to the control signal terminal EM, a first terminal of the ninth transistor M9 is connected to the first electric level terminal V1, and a second terminal of the ninth transistor M9 is connected to the fourth node d. A gate electrode of the tenth transistor M10 is connected to the control signal terminal EM, a first terminal of the tenth transistor M10 is connected to the third node c, and a second terminal of the tenth transistor M10 is connected to a first electrode of the organic light emitting diode OLED. A second electrode of the organic light emitting diode OLED is connected to the second electric level terminal V2.

Wherein the second transistor M2 is a driving transistor, and other transistors are switching transistors. Hereinafter, the functions of the respective units during the process of compensating the threshold voltage of the driving unit will be briefly described below. Firstly, the third transistor M3, the fourth transistor M4, and the fifth transistor M5 in the preset unit 11 are in a ON state under the control of the signal of the first scanning signal terminal S1, the electric level of the first node a is pulled to the electric level of the second electric level terminal V2 via the fourth transistor M4, the electric level of the third node c is pulled to the electric level of the second electric level terminal V2 via the fifth transistor M5. The signal of the first scanning signal terminal S1 is written into the second node b via the third transistor M3. Secondly, the sixth transistor M6, the seventh transistor M7, and the eighth transistor M8 in the compensation unit 12 are in a ON state under the control of the second scanning signal terminal S2, the electric level of the first node a is pulled to the electric level of the second scanning signal terminal V2 via the sixth transistor M6, and the electric level of the third node c is pulled to the electric level of the second scanning signal terminal V2 via the eighth transistor M8. The second node b is discharged via the seventh transistor M7 and the fourth node d. Thirdly, the first transistor M1 in the data writing unit 13 is in a ON state under the control of the signal of the third scanning signal terminal S3, the signal of the data signal terminal Data is written into the first node a via the first transistor M1. Finally, in the light emitting unit 14, the ninth transistor M9 and the tenth transistor M10 are in a ON state under the control of the signal of the control signal terminal EM, the signal of the first electric level terminal V1 is written into the fourth node d via the ninth transistor M9, the driving signal of the third node c is inputted to the first electrode of the organic light emitting diode OLED via the tenth transistor M10, and the organic light emitting diode OLED is controlled to emit light with the driving signal and the signal of the second electric level terminal V2 connected to the second electrode of the organic light emitting diode OLED. Wherein, since C1 in the energy storage unit stores the threshold voltage of M2 in the driving unit, in the light emitting stage, a threshold voltage compensation may be carried out to M2 in the driving unit directly with the stored threshold voltage.

The above-mentioned transistors are the same type of "N-type" or "P-type" transistors. Of course, in the process of manufacturing the display panel, using transistors of the same type facilitates reducing the manufacturing processes, and ensures the uniformity of device performance, "N"-type transistors are preferably employed. Further, the light emitting component herein may be an active light emitting diode OLED, and when the first electrode of the OLED is an anode, the electric level $V_2$ of the second electric level terminal V2 is lower than the level $V_1$ of the first electric level terminal V1. In the embodiments of the present disclosure, the low electric level may be ground. In FIG. 2, the first electrode being an anode OLED is taken as an example.

The pixel circuit provided by the embodiments of the disclosure can perform threshold voltage compensation to the driving unit through the compensation unit, prevent the drift of the threshold voltage of the driving transistor of the driving unit from affecting the driving current of the active light emitting component, and further improve the uniformity of the displayed image.

Figure 3:
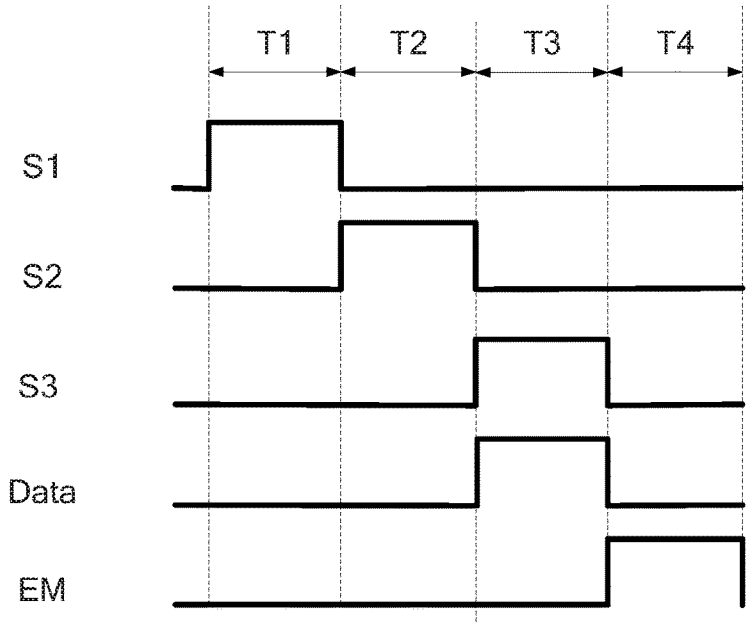
FIG. 3 is a schematic signal timing state diagram of the pixel circuit shown in FIG. 2.

FIG. 3 is a schematic signal timing state diagram of the pixel circuit shown in FIG. 2. Hereinafter, a driving method of the pixel circuit will be described in conjunction with FIG. 3. The driving method of the pixel circuit comprises: a first stage, wherein the signal on the first scanning signal terminal is valid, and the preset unit connects a first node and a third node to the second electric level terminal, and connects the first scanning signal terminal to the second node under the control of the signal of the first scanning signal terminal. A second stage, wherein the signal of the second scanning signal terminal is valid, and the compensation unit connects the first node and the third node to the second electric level terminal, and connects the fourth node to the second node under the control of the signal of the second scanning signal terminal. The energy storage unit stores the threshold voltage of the driving unit. A third stage, wherein the signal of the third scanning signal terminal is valid, the signal of the data signal terminal is valid, and the data writing unit connects the data signal terminal to the first node under the control of the signal of the third scanning signal terminal. A fourth stage, wherein the signal of the control signal terminal is valid, and the driving unit outputs a driving signal to the third node under the control of the voltage between the second node and the fourth node. The light emitting unit connects the first electric level terminal to the fourth node under the control of the control signal terminal, receives the driving signal of the third node, and emits light under the control of the driving signal and the signal of the second level terminal.

In the embodiments of the present disclosure, the preset unit comprises a third transistor, a fourth transistor, and a fifth transistor. In the first stage, the third transistor, the fourth transistor and the fifth transistor are in the ON state under the control of the signal of the first scanning signal terminal, the first node is connected to the second electric level terminal via the fourth transistor, the third node is connected to the second electric level terminal via the fifth transistor, and the first scanning signal terminal is connected to the second node via the third transistor.

In the embodiments of the present disclosure, the compensation unit comprises a sixth transistor, a seventh transistor, and an eighth transistor. In the second stage, the sixth transistor, the seventh transistor and the eighth transistor are in the ON state under the control of the signal of the second scanning signal terminal, the first node is connected to the second electric level terminal via the sixth transistor, the third node is connected to the second electric level terminal via the eighth transistor, and the second node is connected to the fourth node via the seventh transistor.

In the embodiments of the present disclosure, the data writing unit comprises a first transistor. In the third stage, the first transistor is in the ON state under the control of the signal of the third scanning signal terminal. The data signal terminal is connected to the first node via the first transistor.

In the embodiments of the present disclosure, the light emitting unit comprises a ninth transistor, a tenth transistor, and an organic light emitting diode. In the fourth stage, the ninth transistor and the tenth transistor are in the ON state under the control of the signal of the control signal terminal, the first electric level terminal is connected to the fourth node via the ninth transistor, the third node is connected to the first electrode of the organic light emitting diode via the tenth transistor, and the organic light emitting diode is controlled to emit light with the driving signal and the signal of the second electric level terminal connected to the second electrode of the organic light emitting diode.

The driving method of the pixel circuit provided by the embodiments of the disclosure can perform threshold voltage compensation to the driving unit through the compensation unit, prevent the drift of the threshold voltage of the driving transistor of the driving unit from affecting the driving current of the active light emitting component, and further improve the uniformity of the displayed image.

Figure 4:
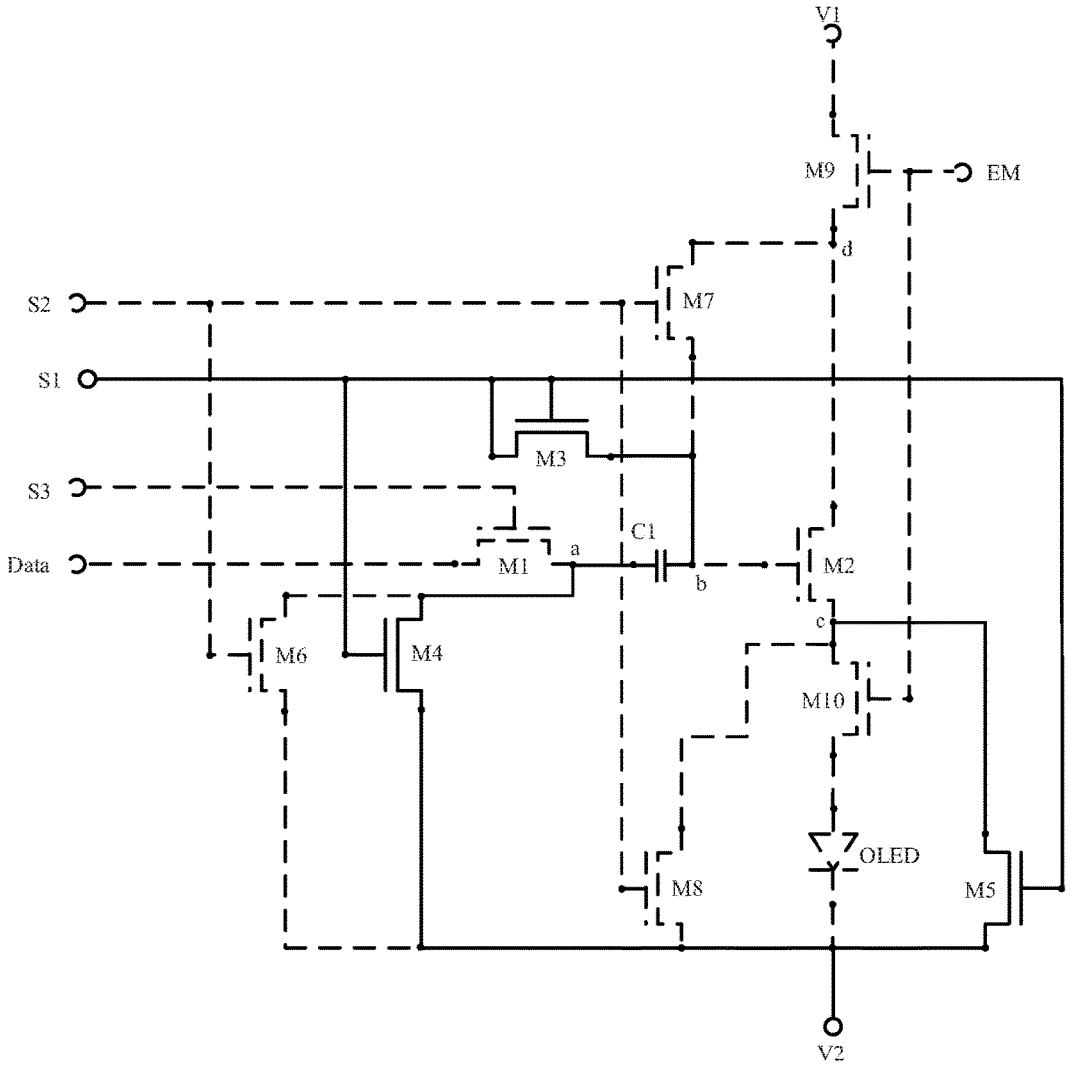
FIG. 4 is a schematic equivalent circuit diagram of the pixel circuit shown in FIG. 2 in a first stage.
Figure 5:
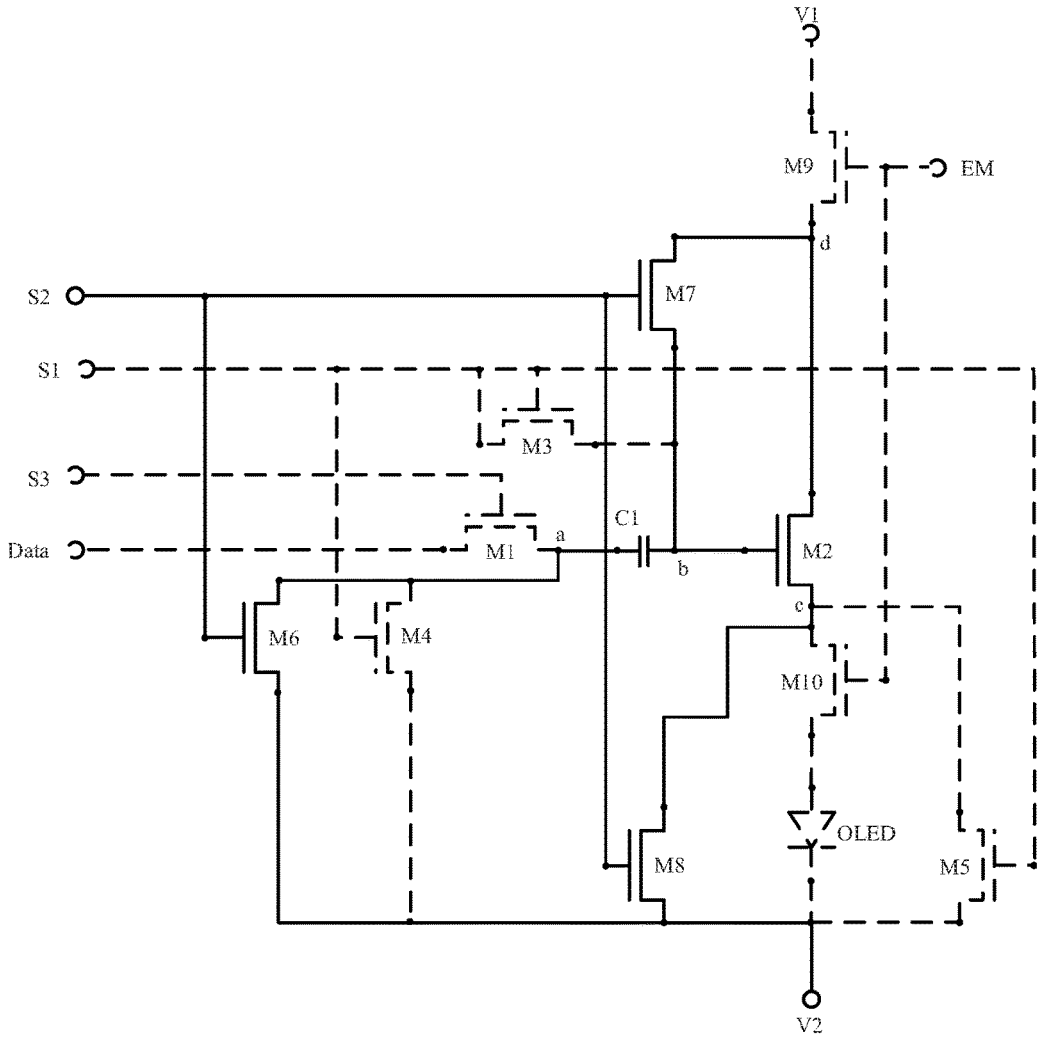
FIG. 5 is a schematic equivalent circuit diagram of the pixel circuit shown in FIG. 2 in a second stage.
Figure 6:
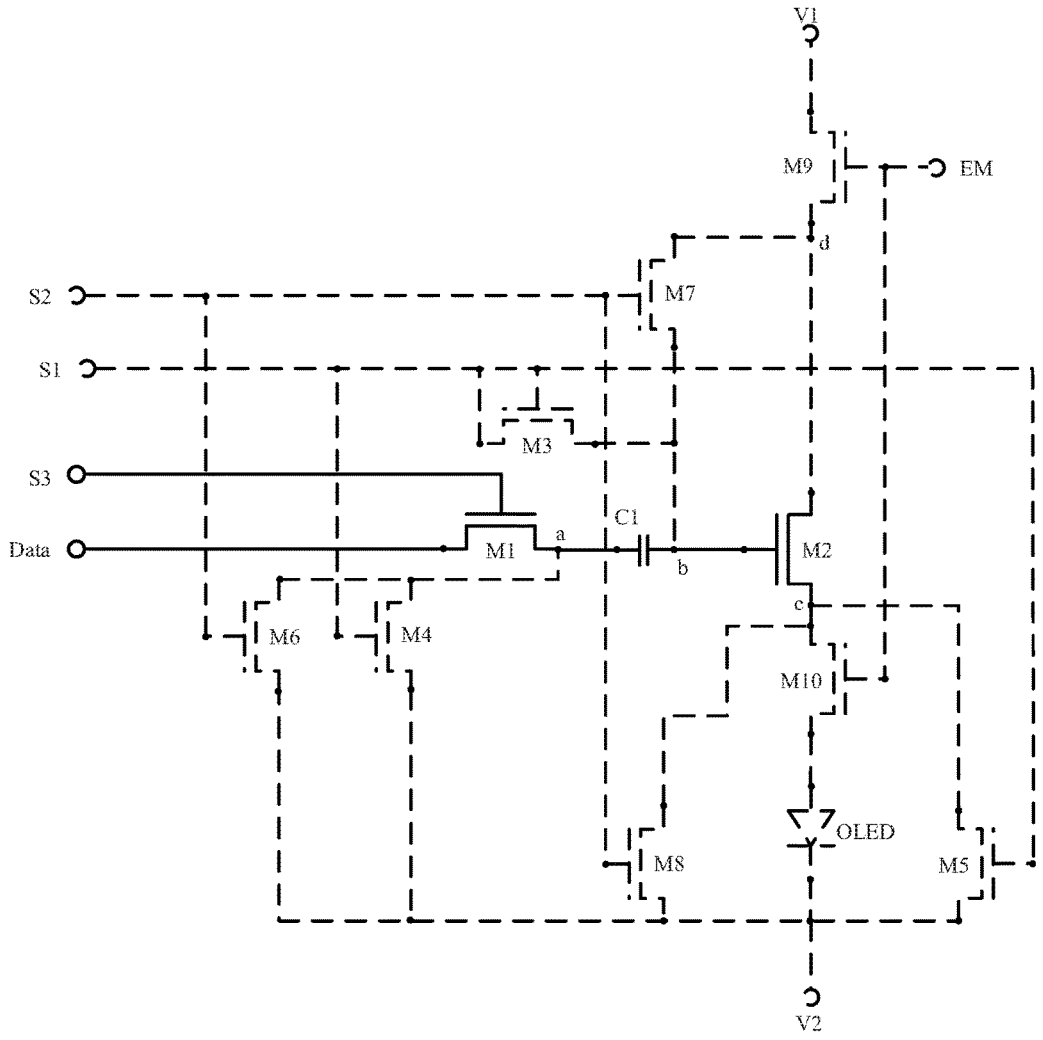
FIG. 6 is a schematic equivalent circuit diagram of the pixel circuit shown in FIG. 2 in a third stage.
Figure 7:
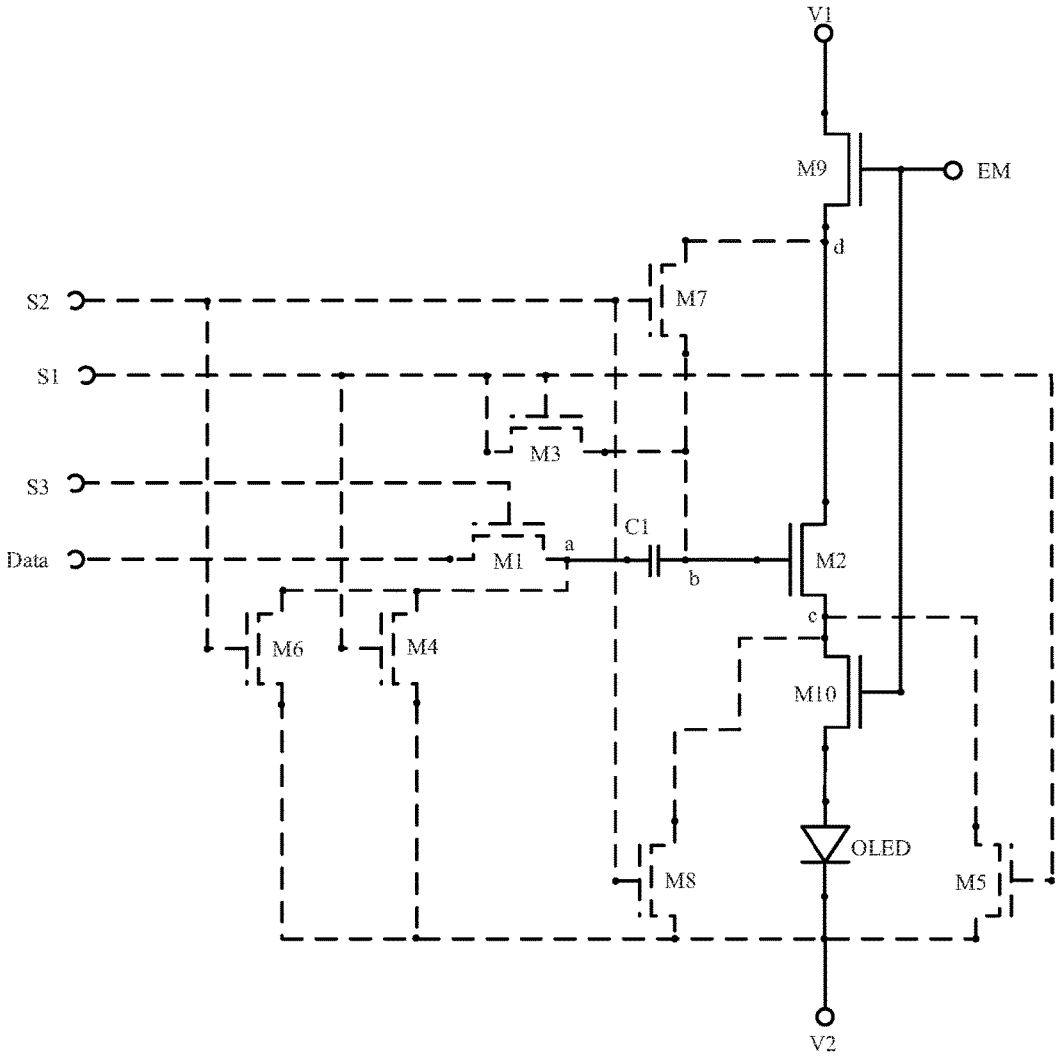
FIG. 7 is a schematic equivalent circuit diagram of the pixel circuit shown in FIG. 2 in a fourth stage.

The driving method will be described in further detail below. FIG. 4 is a schematic equivalent circuit diagram of the pixel circuit shown in FIG. 2 in the first stage. FIG. 5 is a schematic equivalent circuit diagram of the pixel circuit shown in FIG. 2 in the second stage. FIG. 6 is a schematic equivalent circuit diagram of the pixel circuit shown in FIG. 2 in the third stage. FIG. 7 is a schematic equivalent circuit diagram of the pixel circuit shown in FIG. 2 in the fourth stage. FIGS. 4 to 7 use solid lines to indicate the ON transistors and lines, and broken lines to indicate non-ON transistors and lines. Here, such an example is taken that each transistor is a "N"-type transistor, to the V1 terminal of which a high level $V_{DD}$ signal is applied and to the V2 terminal of which a low level $V_{SS}$ signal is applied. Referring to the pixel circuit provided in FIG. 2, to the schematic signal timing state diagram of the pixel circuit provided by FIG. 3, and at the same time to the schematic equivalent circuit diagrams of the pixel circuit shown in FIGS. 4 to 7 in the operation state in respective stages, the embodiments of the present disclosure provide a driving method of a pixel circuit. The circuit working principle is divided into four parts, namely, the preset stage of the first stage T1, the threshold voltage writing stage of the second stage T2, the third stage T3 which is the data signal writing stage, and the fourth stage T4 which is the light emitting stage.

In the preset stage of T1, S1=1, S2=0, S3=0, EM=0. It should be noted that in the following embodiment, "0" indicates a low level; "1" indicates a high level; S1=1 indicates that a signal of high level is applied to the first scanning signal terminal, and so on. Referring to the equivalent circuit diagram shown in FIG. 4, S2, S3, EM are low-voltage off signals, and S1 is a high-voltage on-signal state. At this point M3, M4, M5 are tuned on, the node b is at a high level, while the nodes a, c remain at a low level.

In the threshold voltage writing stage of T2, S1=0, S2=1, S3=0, EM=0. Referring to the equivalent circuit diagram shown in FIG. 5, S1, S3, EM are low-voltage off signals, S2 is a high-voltage ON signal state. At this point M2, M6, M7, M8 are turned on, the node b is discharged via M7 and M8 to the threshold voltage ($V_{th}$) of M2, the potentials of the nodes a, c remain low. Thus the capacitor C1 will store the threshold voltage of M2 in the C1 capacitor.

In the data signal writing stage of T3, S1=0, S2=0, S3=1 and EM=0. Referring to the equivalent circuit diagram shown in FIG. 6, S1, S2 and EM are low-voltage off signals, S3 is a high-voltage ON signal state. At this point M1 is turned on, the Data inputs the data signal $V_{Data}$, the potential of the node a is consistent with $V_{Data}$, and because M7, M8 are off, due to the bootstrap function of the capacitor C1, the potential of the node b is $V_{Data}+V_{th}$.

In the light emitting stage of T4, S1=0, S2=0, S3=0, EM=1. Referring to the equivalent circuit diagram shown in FIG. 7, S1, S2, S3 are low-voltage off signals, EM is a high-voltage ON signal state. At this point M9, M10 are turned on, the potential of the node b in the light emitting stage is the same as in the T3 stage, both being $V_{Data}+V_{th}$. Since M2 is in a saturated stage, it can be seen according to the current formula in a saturated region of the transistor:

$$\begin{aligned} I_{OLED} &= \frac{1}{2}K(V_{GS}-V_{th})^2 \\ &= \frac{1}{2}K[V_{Data}+V_{th}-V_{DD}-V_{th}]^2 \\ &= \frac{1}{2}K(V_{Data}-V_{DD})^2 \end{aligned}$$

Wherein, $V_{GS}$ is the voltage difference between the source electrode and gate electrode of M2, $$K = \mu C_{ox}\frac{W}{L},$$

μ and $C_{ox}$ are process constants, W is the channel width of M2, L is the channel length of the transistor, W and L are optionally designed constants, whereby the current amount is merely associated with $V_{Data}$ and $V_{DD}$. $V_{DD}$ is a set value, so from the above formula it can be seen that the operating current $I_{OLED}$ has already been not affected by the threshold voltage $V_{th}$, and is merely related with $V_{Data}$. The problem that the threshold voltage drifts due to the manufacturing processes and the long-time operation is completely solved, its impact on the $I_{OLED}$ is eliminated, and the normal operation of OLED is ensured.

Embodiments of the present disclosure provide a display panel comprising the above-described pixel circuit.

Embodiments of the present disclosure provide a display device comprising the above-described display panel. In addition, the display device may be a display device such as an electronic paper, a mobile phone, a television, a digital photo frame, or the like.

The display device provided by the embodiments of the disclosure can perform threshold voltage compensation to the driving unit through the compensation unit, prevent the drift of the threshold voltage of the driving transistor of the driving unit from affecting the driving current of the active light emitting component, and further improve the uniformity of the display image.

The foregoing is merely about the specific embodiments of the present disclosure, but the scope of the disclosure is not limited thereto. Any person skilled in the art may easily conceive of variations and substitutions in the technical scope revealed by the prevent disclosure, those variations and substitutions shall be included in the scope of the prevent disclosure sought for protection. Accordingly, the scope of protection of the present disclosure should be determined by the scope of the claims.

The invention claimed is:

1. A pixel circuit comprising: a preset unit, a compensation unit, a data writing unit, a driving unit, an energy storage unit, and a light emitting unit, wherein the preset unit is connected to a first scanning signal terminal, a first node, a second node, a third node and a second electric level terminal, and is configured to connect the first node and the third node to the second electric level terminal, and to provide a first scanning signal from the first scanning signal terminal to the second node, based on the first scanning signal provided to the first scanning signal terminal, wherein the compensation unit is connected to a second scanning signal terminal, the first node, the second node, the third node, a fourth node and the second electric level terminal, and is configured to connect the first node and the third node to the second electric level terminal, and to connect the fourth node to the second node, based on a second scanning signal provided to the second scanning signal terminal, wherein the data writing unit is connected to a third scanning signal terminal, a data signal terminal and the first node, and is configured to connect the data signal terminal to the first node under the control of a signal of the third scanning signal terminal, wherein the energy storage unit is connected to the first node and the second node, and is configured to store a voltage between the first node and the second node, wherein the driving unit is connected to the second node, the third node and the fourth node, and is configured to output a driving signal to the third node based on a voltage between the second node and the fourth node, wherein the light emitting unit comprises a light emission control unit and a light emitting component, wherein the light emission control unit is connected to a control signal terminal, the third node, the fourth node, a first electric level terminal and the light emitting component, the light emitting component is connected to the light emission control unit and the second electric level terminal, the light emission control unit is configured to connect the first electric level terminal to the fourth node and to connect the third node to the light emitting component under the control of the signal of the control signal terminal, the light emitting component is configured to emit light based on the driving signal and a signal provided to the second electric level terminal, and wherein the second electric level terminal is directly connected to a cathode of the light emitting component for providing said signal provided to the second electric level terminal to the cathode of the light emitting component.

2. The pixel circuit according to claim 1, wherein the preset unit comprises a third transistor, a fourth transistor, and a fifth transistor, wherein a control electrode of the third transistor is connected to the first scanning signal terminal, a first terminal of the third transistor is connected to the first scanning signal terminal, and a second terminal of the third transistor is connected to the second node, wherein a control electrode of the fourth transistor is connected to the first scanning signal terminal, a first terminal of the fourth transistor is connected to the first node, and a second terminal of the fourth transistor is connected to the second electric level terminal, and wherein a control electrode of the fifth transistor is connected to the first scanning signal terminal, a first terminal of the fifth transistor is connected to the third node, and a second terminal of the fifth transistor is connected to the second electric level terminal.

3. The pixel circuit according to claim 1, wherein the compensation unit comprises a sixth transistor, a seventh transistor, and an eighth transistor, wherein a control electrode of the sixth transistor is connected to the second scanning signal terminal, a first terminal of the sixth transistor is connected to the first node, and a second terminal of the sixth transistor is connected to the second electric level terminal, wherein a control electrode of the seventh transistor is connected to the second scanning signal terminal, a first terminal of the seventh transistor is connected to the fourth node, and a second terminal of the seventh transistor is connected to the second node, and wherein a control electrode of the eighth transistor is connected to the second scanning signal terminal, a first terminal of the eighth transistor is connected to the third node, and a second terminal of the eighth transistor is connected to the second electric level terminal.

4. The pixel circuit according to claim 1, wherein the data writing unit comprises a first transistor, and wherein a control electrode of the first transistor is connected to the third scanning signal terminal, a first terminal of the first transistor is connected to the data signal terminal, and a second terminal of the first transistor is connected to the first node.

5. The pixel circuit according to claim 1, wherein the driving unit comprises a second transistor, and wherein a control electrode of the second transistor is connected to the second node, a first terminal of the second transistor is connected to the fourth node, and a second terminal of the second transistor is connected to the third node.

6. The pixel circuit according to claim 1, wherein the energy storage unit comprises a first capacitor, and wherein a first electrode of the first capacitor is connected to the first node, and a second electrode of the first capacitor is connected to the second node.

7. The pixel circuit according to claim 1, wherein the light emission control unit comprises a ninth transistor and a tenth transistor, wherein the light emitting component comprises an organic light emitting diode, wherein a control electrode of the ninth transistor is connected to the control signal terminal, a first terminal of the ninth transistor is connected to the first electric level terminal, and a second terminal of the ninth transistor is connected to the fourth node, wherein a control electrode of the tenth transistor is connected to the control signal terminal, a first terminal of the tenth transistor is connected to the third node, and a second terminal of the tenth transistor is connected to a first electrode of the organic light emitting diode, and wherein a second electrode of the organic light emitting diode is connected to the second electric level terminal.

8. A display panel comprising the pixel circuit according to claim 1.

9. A display device comprising the display panel according to claim 8.

10. The display panel according to claim 8, wherein the preset unit comprises a third transistor, a fourth transistor, and a fifth transistor, wherein a control electrode of the third transistor is connected to the first scanning signal terminal, a first terminal of the third transistor is connected to the first scanning signal terminal, and a second terminal of the third transistor is connected to the second node, wherein a control electrode of the fourth transistor is connected to the first scanning signal terminal, a first terminal of the fourth transistor is connected to the first node, and a second terminal of the fourth transistor is connected to the second electric level terminal, and wherein a control electrode of the fifth transistor is connected to the first scanning signal terminal, a first terminal of the fifth transistor is connected to the third node, and a second terminal of the fifth transistor is connected to the second electric level terminal.

11. The display panel according to claim 8, wherein the compensation unit comprises a sixth transistor, a seventh transistor, and an eighth transistor, wherein a control electrode of the sixth transistor is connected to the second scanning signal terminal, a first terminal of the sixth transistor is connected to the first node, and a second terminal of the sixth transistor is connected to the second electric level terminal, wherein a control electrode of the seventh transistor is connected to the second scanning signal terminal, a first terminal of the seventh transistor is connected to the fourth node, and a second terminal of the seventh transistor is connected to the second node, and wherein a control electrode of the eighth transistor is connected to the second scanning signal terminal, a first terminal of the eighth transistor is connected to the third node, and a second terminal of the eighth transistor is connected to the second electric level terminal.

12. The display panel according to claim 8, wherein the data writing unit comprises a first transistor, and wherein a control electrode of the first transistor is connected to the third scanning signal terminal, a first terminal of the first transistor is connected to the data signal terminal, and a second terminal of the first transistor is connected to the first node.

13. The display panel according to claim 8, wherein the driving unit comprises a second transistor, and wherein a control electrode of the second transistor is connected to the second node, a first terminal of the second transistor is connected to the fourth node, and a second terminal of the second transistor is connected to the third node.

14. The display panel according to claim 8, wherein the energy storage unit comprises a first capacitor, and wherein a first electrode of the first capacitor is connected to the first node, and a second electrode of the first capacitor is connected to the second node.

15. The display panel according to claim 8, wherein the light emission control unit comprises a ninth transistor and a tenth transistor, wherein the light emitting component comprises an organic light emitting diode, wherein a control electrode of the ninth transistor is connected to the control signal terminal, a first terminal of the ninth transistor is connected to the first electric level terminal, and a second terminal of the ninth transistor is connected to the fourth node, wherein a control electrode of the tenth transistor is connected to the control signal terminal, a first terminal of the tenth transistor is connected to the third node, and a second terminal of the tenth transistor is connected to a first electrode of the organic light emitting diode, and wherein a second electrode of the organic light emitting diode is connected to the second electric level terminal.

16. A driving method of a pixel circuit for driving the pixel circuit according to claim 1, the driving method comprising:

a first stage: connecting the first node and the third node to the second electric level terminal and connecting the first scanning signal terminal to the second node, via the preset unit, based on the first scanning signal provided to the first scanning signal terminal, a second stage: connecting the first node and the third node to the second electric level terminal and connecting the fourth node to the second node, via the compensation unit, based on the second scanning signal provided to the second scanning signal terminal, and storing with the energy storage unit, a threshold voltage of the driving unit, a third stage: connecting the data signal terminal to the first node, via the data writing unit, based on the third scanning signal provided to the third scanning signal terminal, and a fourth stage: outputting the driving signal to the third node, via the driving unit, based on the voltage between the second node and the fourth node, connecting the first electric level terminal to the fourth node and connecting the third node to a first electrode of the light emitting component, via the light emission control unit, based on the control signal provided to the control signal terminal, and emitting light, with the light emitting component, based on the driving signal and the signal provided to a second electric level terminal.

17. The method according to claim 16, wherein the preset unit comprises a third transistor, a fourth transistor, and a fifth transistor, and wherein in the first stage, the third transistor, the fourth transistor and the fifth transistor are in the ON state based on the first scanning signal provided to the first scanning signal terminal, the first node is connected to the second electric level terminal via the fourth transistor, the third node is connected to the second electric level terminal via the fifth transistor, and the first scanning signal terminal is connected to the second node via the third transistor.

18. The method according to claim 16, wherein the compensation unit comprises a sixth transistor, a seventh transistor, and an eighth transistor, and wherein in the second stage, the sixth transistor, the seventh transistor and the eighth transistor are in the ON state based on the second scanning signal provided to the second scanning signal terminal, the first node is connected to the second electric level terminal via the sixth transistor, the third node is connected to the second electric level terminal via the eighth transistor, and the second node is connected to the fourth node via the seventh transistor.

19. The method according to claim 16, wherein the data writing unit comprises a first transistor, and wherein in the third stage, the first transistor is in the ON state based on the third scanning signal provided to the third scanning signal terminal, the data signal terminal is connected to the first node via the first transistor.

20. The method according to claim 16, wherein the light emitting unit comprises a ninth transistor, a tenth transistor, and an organic light emitting diode, and wherein in the fourth stage, the ninth transistor and the tenth transistor are in the ON state based on the control signal provided to the control signal terminal, the first electric level terminal is connected to the fourth node via the ninth transistor, the third node is connected to a first electrode of the organic light emitting diode via the tenth transistor, the organic light emitting diode is controlled to emit light with the driving signal and the signal of the second electric level terminal connected to a second electrode of the organic light emitting diode.

* * * * *